US005770258A

United States Patent [19]

Takizawa et al.

[11] Patent Number: 5,770,258

[45] Date of Patent: Jun. 23, 1998

[54] CATHODE-RAY TUBE AND METHOD OF PRODUCING THE SAME

[75] Inventors: Tomoki Takizawa; Hiroshi Okuda, both of Nagaokakyo, Japan

[73] Assignee: Mitsubishi Denki Kabushiki Kaisha, Tokyo, Japan

[21] Appl. No.: 434,586

[22] Filed: May 4, 1995

Related U.S. Application Data

[62] Division of Ser. No. 170,765, Dec. 21, 1993, Pat. No. 5,519,282.

[30] Foreign Application Priority Data

Dec. 25, 1992 [JP] Japan ..... 4-346458
Nov. 17, 1993 [JP] Japan ..... 5-288173

[51] Int. Cl.[6] ..... B05D 5/12

[52] U.S. Cl. ..... 427/64; 427/68; 427/108; 427/126.2; 427/126.3; 427/240; 427/165; 427/167; 427/168; 427/419.3

[58] Field of Search ..... 427/64, 68, 240, 427/126.2, 126.3, 108, 165, 167, 168, 419.3

[56] References Cited

U.S. PATENT DOCUMENTS

| | | | |
|---|---|---|---|
| 3,185,020 | 5/1965 | Thelen | 359/586 |
| 3,854,796 | 12/1974 | Thelen | 359/588 |
| 4,804,883 | 2/1989 | Mueller et al. | 313/478 |
| 4,945,282 | 7/1990 | Kawamura | 427/64 |
| 5,051,652 | 9/1991 | Isomura et al. | 313/479 |
| 5,068,568 | 11/1991 | de Vrieze et al. | 313/474 |
| 5,099,171 | 3/1992 | Daiku et al. | 313/479 |
| 5,122,709 | 6/1992 | Kawamura et al. | 313/479 |
| 5,288,558 | 2/1994 | Nothe | 428/478 |
| 5,328,871 | 7/1994 | Tanigawa et al. | 437/231 |

FOREIGN PATENT DOCUMENTS

| | | |
|---|---|---|
| 0263541 | 4/1988 | European Pat. Off. . |
| 61-250939 | 11/1986 | Japan . |
| 1211830 | 8/1989 | Japan . |
| 351801 | 3/1991 | Japan . |

*Primary Examiner*—Janyce Bell

[57] ABSTRACT

A method of producing a cathode-ray tube (CRT) of anti-static-processed type and further a cathode-ray tube which screens a leakage electric field (VLF band width). The method including the steps of forming a high-refractive transparent conductive layer, a low-refractive smooth transparent layer, and a low-refractive rough transparent layer on a faceplate of the CRT. This triple coat layer serving to reduce the weight of the CRT, minimize the deterioration of the resolution and contrast of images displayed, diminish the reflection of external light, and provide sufficient film strength for practical use.

11 Claims, 15 Drawing Sheets

CATHODE-RAY TUBE AND METHOD OF PRODUCING THE SAME

This application is a divisional of application Ser. No. 08/170,765, filed on Dec. 21, 1993, now U.S. Pat. No. 5,619,282, the entire contents of which are hereby incorporated by reference.

BACKGROUND OF THE INVENTION

1. Field of the Invention

The present invention relates to a cathode-ray tube (hereinafter referred to as CRT) in which an anti-reflection film, anti-static film, and film for screening the CRT from a leakage electric field (VLF band width) are provided on the surface of its face plate.

2. Description of Related Art

Because of its principle of operation, a high voltage over 20 kV is applied to the phosphor screen of a CRT in order to accelerate an electron beam. As higher luminance and resolution have been realized in recent years, a high voltage of 30 kV or more is applied in a CRT for a color television. Even in a CRT for a display monitor, a voltage as high as 25 kV is applied. When the power source for the associated set is turned on, the outer surface of the face plate of a CRT charges Up, so that a discharging phenomenon may occur when the viewer comes close to the CRT, thus causing an uncomfortable sensation or an electrical shock to the viewer.

In order to prevent such a phenomenon, a coating film having a surface resistance value of about $10^9$ Ω/□ is conventionally formed on the face plate, or a glass panel provided with a conductive film having a surface resistance value of about $10^9$ is bonded to the surface of the face plate by means of a UV (ultraviolet) curing resin having substantially the same refractive index as that of the glass panel, so that a part of the coating film or conductive film is grounded via a metal anti-explosion band wound around the face plate, thereby causing a discharge.

FIG. 1 is a side view schematically showing a conventional CRT of anti-static-processed type, which is provided with the function of preventing a static-electrical charge mentioned above. In the drawing, numeral 1 denotes a CRT, and on the face plate section 3 formed on the front face of the CRT 1 is provided a glass panel 2 having a conductive film via a UV curing resin. The glass panel 2 may be composed of a rough conductive film 2 formed on the surface of the face plate section 3.

The side portion of the CRT 1 constitutes a funnel section 4 which is provided with a high-voltage button 5 in the upper part thereof. The back portion of the CRT 1 constitutes a neck section 6 in which an electron gun (not shown) is built. Over the boundary between the funnel section 4 and neck section 6 is fixed a deflection yoke 7. The high-voltage button 5, electron gun, and deflection yoke 7 are connected to a high-voltage power source 35, driving power source 36, and deflection power source 37 via lead wires 5*a*, 6*a*, and 7*a*, respectively.

Around the side face of the face plate section 3 is provided the metal anti-explosion band 9, which is fixed thereto by means of a conductive tape 8 provided around the glass panel 2. The conductive tape 8 may be substituted with a conductive paste. To the metal anti-explosion band 9 is attached a mounting lug 10, which is connected to the ground 12 via all ground wire 11. The glass panel 2 having the conductive film is connected to the ground 12 via the conductive tape 8, anti-explosion band 9, mounting lug 10, and ground wire 11, so that the charge is constantly connected to the ground 12.

In the CRT 1 thus constituted, an electron beam emitted from the electron gun which is built in the neck section 6 is electromagnetically deflected by the deflection yoke 7, while a high voltage is applied onto the phosphor screen provided on the inner surface of the face plate section 3 via the high-voltage button 5 so as to accelerate the electron beam. The resulting energy of the accelerated electron beam excites the phosphor screen to emit light, thus obtaining a light output.

As described above, the outer surface of the face plate section 3 charges up under the influence of the high voltage applied to the phosphor screen provided on the inner surface of the face plate section 3, so that a discharging phenomenon occurs when the viewer approaches the face plate section 3, thus causing an uncomfortable sensation or electrical shock to the viewer. The charging up also causes fine particles of dust in the air to land on the outer surface of the face plate section 3, resulting in visible contamination that deteriorates the image quality.

To overcome such problems, conductive coating is provided on the outer surface of the face plate section 3 or a glass panel provided with a conductive film is bonded to the outer surface of the face plate section 3 by means of a UV curing resin having substantially the same refractive index as that of glass, as shown in FIG. 1. By connecting the conductive films to the ground 12, the charge is always allowed to escape to the ground, thereby preventing the charging up of the outer surface of the face plate section 3. For such a CRT of anti-static-processed type, it is sufficient to have a surface resistance value of about $10^9$Ω/□. Therefore, a material which contains fine particles of antimony-containing tin oxide as a filler has been used for coating.

Moreover, since a CRT generally reflects external light on the surface of its face plate, it presents another problem that images displayed thereon are hard to be seen by the viewer. As a means to overcome the problem, such an anti-glaring treatment is performed. According to the treatment, an uneven surface configuration is imparted to the foregoing conductive film so that the external light incident upon the surface of the face plate is irregularly reflected. Due to the uneven configuration, however, not only the external light, incident upon the surface of the face plate but also the light emitted from the phosphor screen are irregularly reflected, resulting in the deterioration of the resolution and contrast of images displayed.

The glass panel 2 provided with the conductive film is typically composed of four optical thin films (of which the lowermost layer is composed of the conductive film). These four optical thin films, which are made of materials having different refractive indices, are formed by vapor deposition in such a manner that films with a high-refractive index and films with a low-refractive films are alternately stacked so as to provide, e.g., a layered structure of light-refractive index/low-refractive index/high-refractive index/low-refractive index, thereby lowering the surface reflectance. In addition, by maintaining the resistance value of the lowermost conductive film at $3\times10^3$ Ω/□ or less, the CRT can be screened from the leakage electric field (VLF band width). Since the four optical thin films are smooth films formed by vapor deposition, they do not deteriorate images displayed and exert sufficient low-reflective effect. However, their material and production cost is increased and their weight is also increased because of the UV curing resin employed for bonding the glass panel to the face plate section.

On the other hand, there has recently been initiated the practical use of a double-layer low-reflective coat, which is obtained by directly coating the face plate section of a CRT. Since the double-layer low-reflective coat, is a smooth film, it is free from the deterioration of the resolution and contrast of images displayed. However, it cannot provide the sufficient low-reflective effect so that the contours of reflected images are disadvantageously sharpened. Furthermore, since visible fingerprints are easily left on the coat, it should have sufficient film strength and, in particular, abrasive resistance to withstand a cleaning process for removing the fingerprints.

The method of producing the double-layer low-reflective coat is subdivided into a method of forming the first high-refractive conductive layer by chemical vapor deposition (hereinafter referred to as CVD) and forming the second layer by spin coating and a method of forming the first and second layers by spin coating. The former CVD technique requires a heating process to elevate the temperature of the face plate section to about 500° C., so that it is not applicable to a post-process performed with respect to a finished CRT. Next, the method of forming the first and second layers by using a spin-coating technique, which can be applicable to a post-process performed with a finish CRT, will be described below.

FIG. 2 is a flow chart illustrating the production process using the spin-coating technique. As shown in the flow chart, the face plate section of a finished CRT is preheated to 40° to 50° C. in a furnace (step S11), and then carried into a first spin booth. In the spin booth are disposed a spinner, coating-solution dispenser, and the like. The spin booth is provided with a function of adjusting the inside temperature, humidity, and dust level. The face plate section of the finished CRT, which has been carried into the spin booth, is spin-coated with a solution for the first layer containing tin oxide ($SnO_2$) which is a conductive material of high-refractive index, silica ($SiO_2$) for forming the film, and an alcohol serving as a solvent, thus forming the first high-refractive conductive layer (step S12).

After performing a drying and curing process at a temperature of about 100° C. (step S13) and then lowering the temperature to 40° to 50° C. (step S14), the CRT is further carried into a second spin booth in which the face plate section is further spin-coated with an alcoholic solution for the second layer containing silica ($SiO_2$) as a low-refractive transparent material, thus forming the second low-refractive transparent layer (step S15). The high-refractive conductive layer and low-refractive transparent layer are then cured by baking at 150° to 200° C. in the furnace, thus forming a CRT with the double-layer low-reflective coat (step S16). The second spin booth is provided with the same function as that of the first spin booth.

In the conventional method described above, the first and second spin booths are independently provided, and the furnace for the drying, curing, and temperature-lowering process after applying the first layer is required, which increases the equipment cost and process steps.

SUMMARY OF THE INVENTION

The present invention has been achieved in order to overcome the above problems. An object of the present invention is to provide a CRT of anti-static type and further a CRT screening itself from a leakage electric field (VLF band width) which have sufficient films strength in reduced process steps and at lower cost, by providing a reflective coat directly on the face plate section thereof, thereby realizing a light-weight CRT, minimizing the deterioration of the resolution and constant of images displayed, and diminishing the reflection of external light.

The CRT according to the present invention is characterized in that it comprises a high-refractive conductive layer, low-refractive smooth transparent layer, and low-refractive rough transparent layer sequentially formed on the outer surface of its face plate. With the triple coat layer, the reflection of external light can be diminished without sharpening the contours of reflected images.

The CRT according to the present invention is also characterized by the structure in which the optical film thickness of the high-refractive conductive layer constituting the triple coat layer is ¼ of the wavelength of incident light, the optical film thickness of the combined layer of the low-refractive smooth transparent layer and low-refractive rough transparent layer is ¼ of the wavelength of incident light, and the glossiness of the low-refractive rough transparent layer with respect to the face-plate glass is 75 to 85%, thereby providing the optimum low-reflective effect. Moreover, by adjusting the glossiness of the low-refractive rough transparent layer, which is the outermost layer, to 75 to 85%, the balance between the anti-glaring effect for blurring the contours of reflected images and the low-reflective effect for diminishing the reflection of external light can be optimized.

In the CRT according to the present invention, the high-refractive conductive layer contains carbon black. Accordingly, by adjusting the amount of carbon black contained therein, the contrast can be improved while the relation between the reduction of surface reflectance and the reduction of luminance is well balanced.

In the CRT according to the present invention, the high-refractive conductive layer contains indium oxide, thereby diminishing the leakage electric field.

A method of producing the CRT according to the present invention is characterized in that it comprises the steps of forming the high-refractive conductive layer on the outer surface of the face plate by spin coating, forming the low-refractive smooth transparent layer on the surface of the high-refractive conductive layer by spin coating, and forming the low-refractive rough transparent layer on the surface of the low-refractive smooth transparent layer by spray coating, thereby providing a triple coat layer of excellent film quality at lower cost.

The method of producing the CRT according to the present invention is also characterized in that, after the low-refractive smooth transparent layer and low-refractive rough transparent layers constituting the triple coat layer are formed, they are cured by baking and that baking is performed at 150° to 200° C. The resulting triple coat layer has sufficient film strength for practical use.

The method of producing the CRT according to the present invention is also characterized in that it comprises the steps of forming the high-refractive layer on the outer surface of the face plate by spin coating, forming the low-refractive smooth transparent layer on the surface of the high-refractive conductive layer by spin coating, and the two layers are cured by balking and that baking is performed at 150° to 200° C. The resulting double coat layer has sufficient film strength for practical use. In the case where the third low-refractive rough transparent layer is formed on the surface of the double coat layer, the triple coat layer with excellent film quality can be obtained.

The method of producing the CRT according to the present invention is also characterized in that the high-refractive conductive layer and low-refractive smooth transparent layer constituting the triple or double coat layer are formed by using the same spinner in the same apparatus, thereby saving space and reducing equipment cost.

The method of producing the CRT according to the present invention is also characterized in that the high-refractive conductive layer which has been formed is dried while being spun. Consequently, the air flow resulting from the spinning of the CRT prevents dust from landing on the surface of the face plate, so that not only the spotting defectives are decreased, but also the time required for drying is reduced and constant film quality is obtained.

The method of producing the CRT according to the present invention is also characterized in that it comprises the steps of forming the high-refractive conductive layer constituting the triple or double coat layer by using a first spinner in an apparatus, drying the high-refractive conductive layer by using drying means disposed in the foregoing apparatus, and then forming the low-refractive smooth transparent layer by using a second spinner in the foregoing apparatus. Thus, by forming the first high-refractive conductive layer and second low-refractive transparent layer by means of different spinners and by using drying means such as an air blower or heater disposed in the same apparatus, the process for drying the first layer can stably be performed. Moreover, by properly adjusting the conditions for forming the first and second layers, such as the revolutions and time for spinning, film quality can be improved.

The above and further objects and features of the invention will more fully be apparent from the following detailed description with accompanying drawings.

Figure 1:
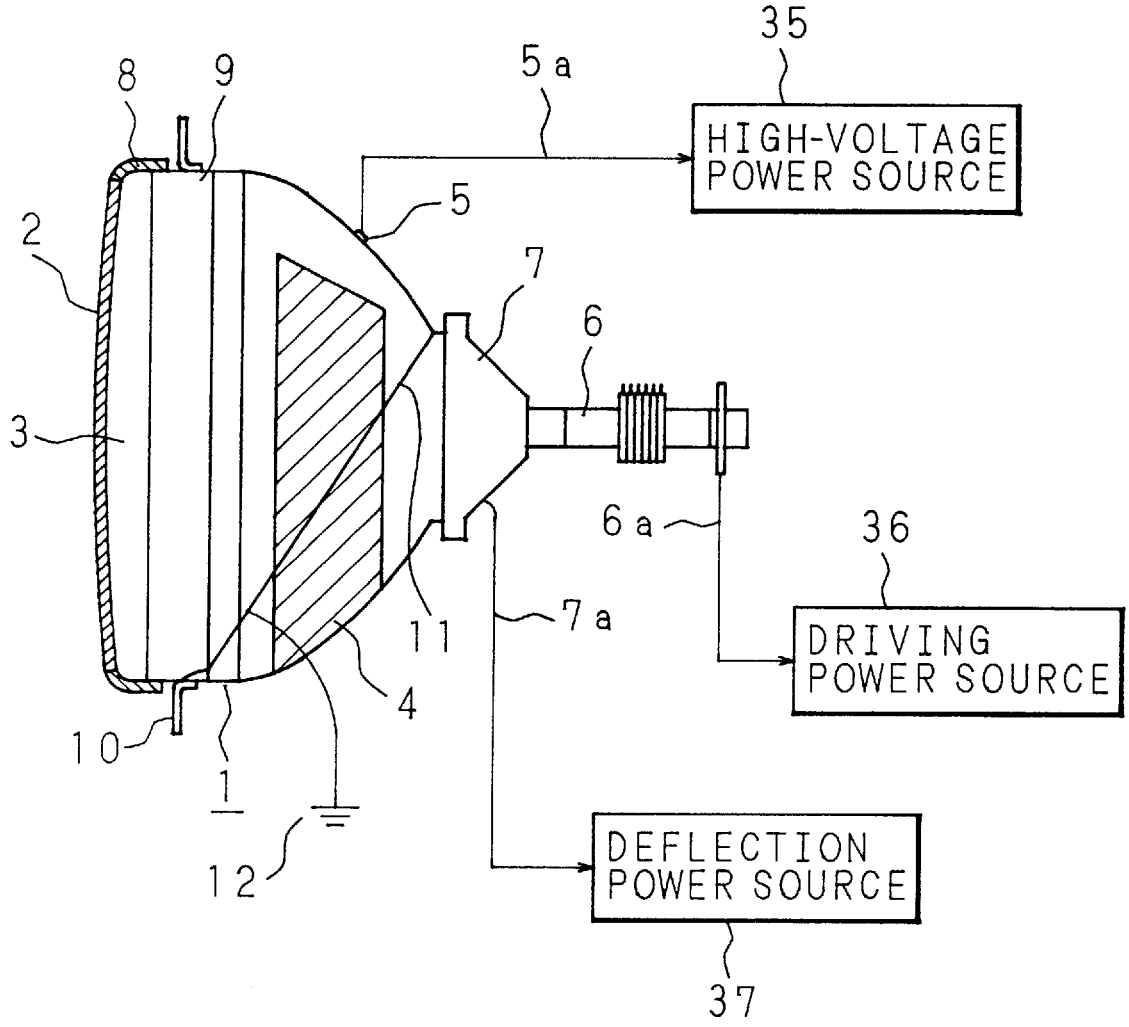
Fig. 1 Prior Art
FIG. 1 is a side view schematically showing a conventional CRT of anti-static-processed type.
Figure 2:
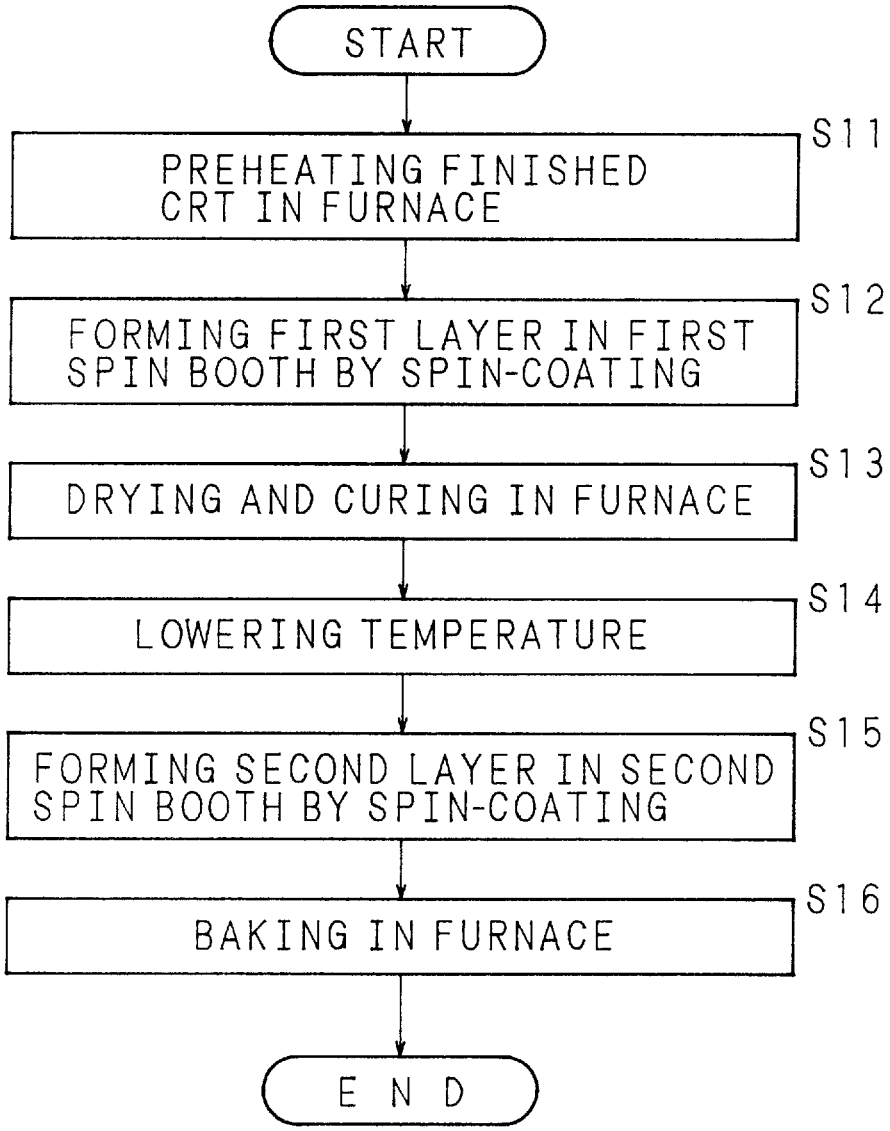
Fig. 2 Prior Art
FIG. 2 is a flow chart illustrating a step of production process for forming a coat layer in a conventional CRT provided with a double-layer low-reflective coat.

DESCRIPTION OF THE PREFERRED EMBODIMENTS (First Embodiment)

Referring now to the drawings, a first embodiment of the present invention will specifically be described below.

Figure 3:
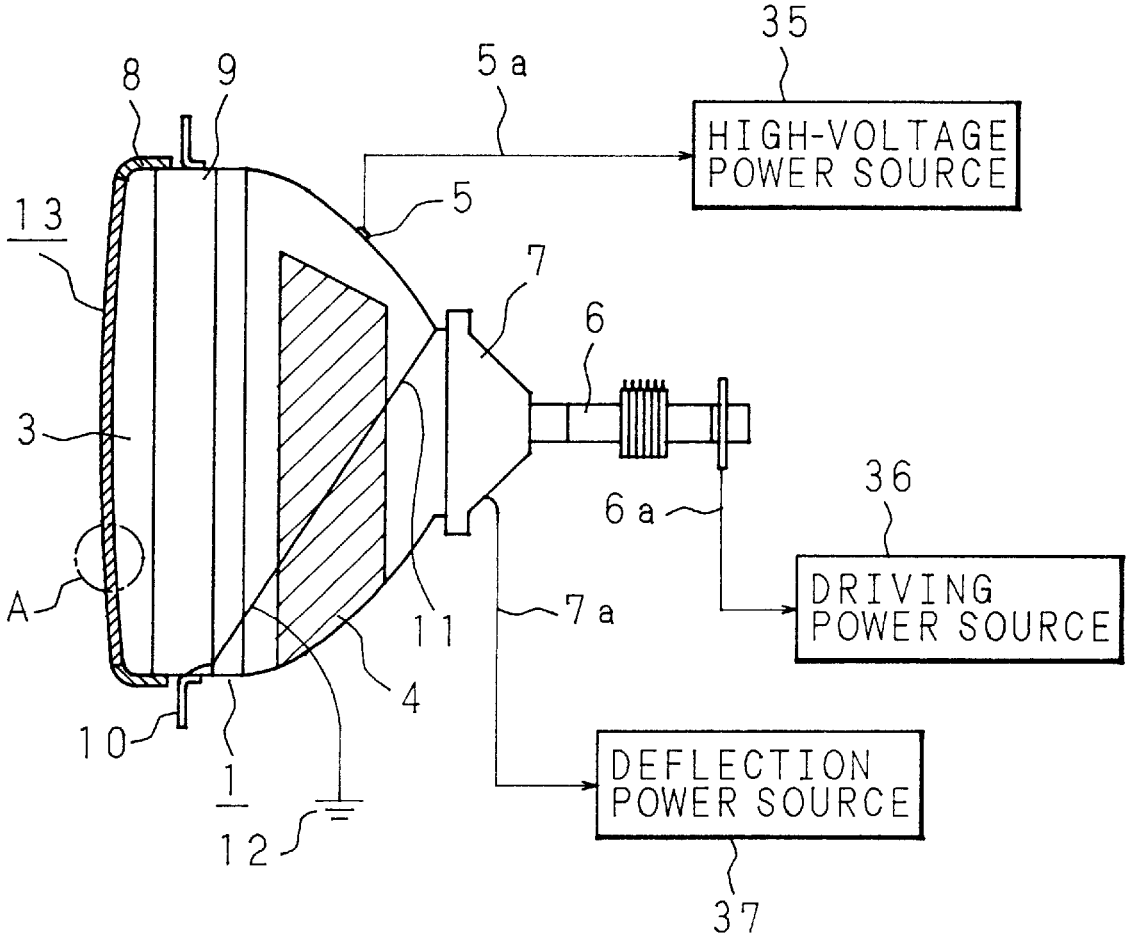
FIG. 3 is a side view schematically showing the structure of a CRT according to a first embodiment of the present invention.
Figure 4:
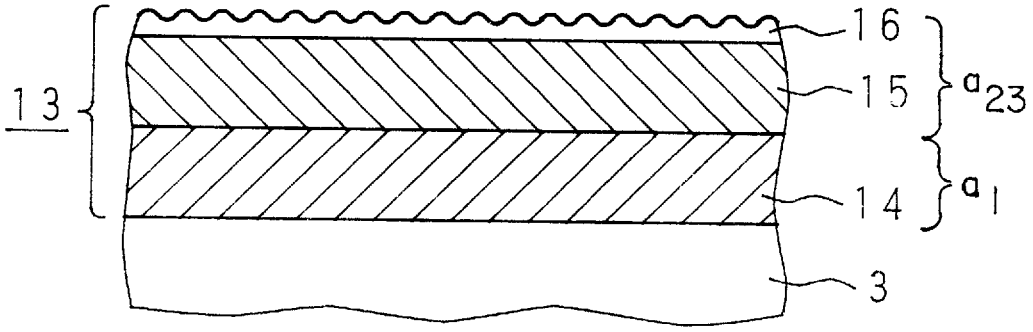
FIG. 4 is a partially enlarged cross section of a portion A of the triple coat layer of FIG. 3.

FIG. 3 is a side view schematically showing the structure of a CRT according to the present invention. In the drawing, numeral 1 denotes the CRT with a face plate section 3 provided on the front face thereof. On the surface of the face plate section 3 is formed a triple coat layer 13. FIG. 4 is a partially enlarged cross section of a portion A of the triple coat layer 13 of FIG. 3. On the face plate section 3, a first high-refractive smooth conductive layer 14 is formed from tin oxide ($SnO_2$) and carbon black by spin coating. On the first layer, a second low-refractive smooth transparent layer 15 is formed from silica $SiO_2$ by spin coating. In the second layer, a third low-refractive rough transparent layer 16 is formed from silica $SiO_2$ by spray coating.

The side portion of the CRT 1 constitutes a funnel section 4 which is provided with a high-voltage button 5 in the tipper part thereof. The back portion of the CRT 1 constitutes a neck section 6 in which an electron gun (not shown) is built. Over the boundary between the funnel section 4 and neck section 6 is fixed a deflection yoke 7. The high-voltage button 5, electron gun, and deflection yoke 7 are connected to a high-voltage power source 35, driving power source 36, and deflection power source 37 via lead wires 5*a,* 6*a,* and 7*a,* respectively.

Around the side face of the face plate section 3 is provided the metal anti-explosion band 9, which is fixed thereto by means of a conductive tape 8 provided around the glass panel 2. The conductive tape 8 may be substituted with a conductive paste. To the metal anti-explosion band 9 is attached a mounting lug 10, which is connected to the ground 12 via a ground wire 11.

In the CRT 1 thus constituted, an electron beam emitted from the electron gun which is built in the neck section 6 is electromagnetically deflected by the deflection yoke 7, while a high voltage is applied onto the phosphor screen provided on the inner surface of the face plate section 3 via the high-voltage button 5 so as to accelerate the electron beam. The resulting energy of the accelerated electron beam excites the phosphor screen to emit light, thus obtaining a light output. Although the high voltage applied causes the face plate section 3 to charge up, the resulting charge is allowed to escape to the ground 12 via the conductive tape 8, metal anti-explosion band 9, mounting lug 10, and ground wire 11, thereby preventing the undesirable effects of the charging up, which were described above.

Figure 5:
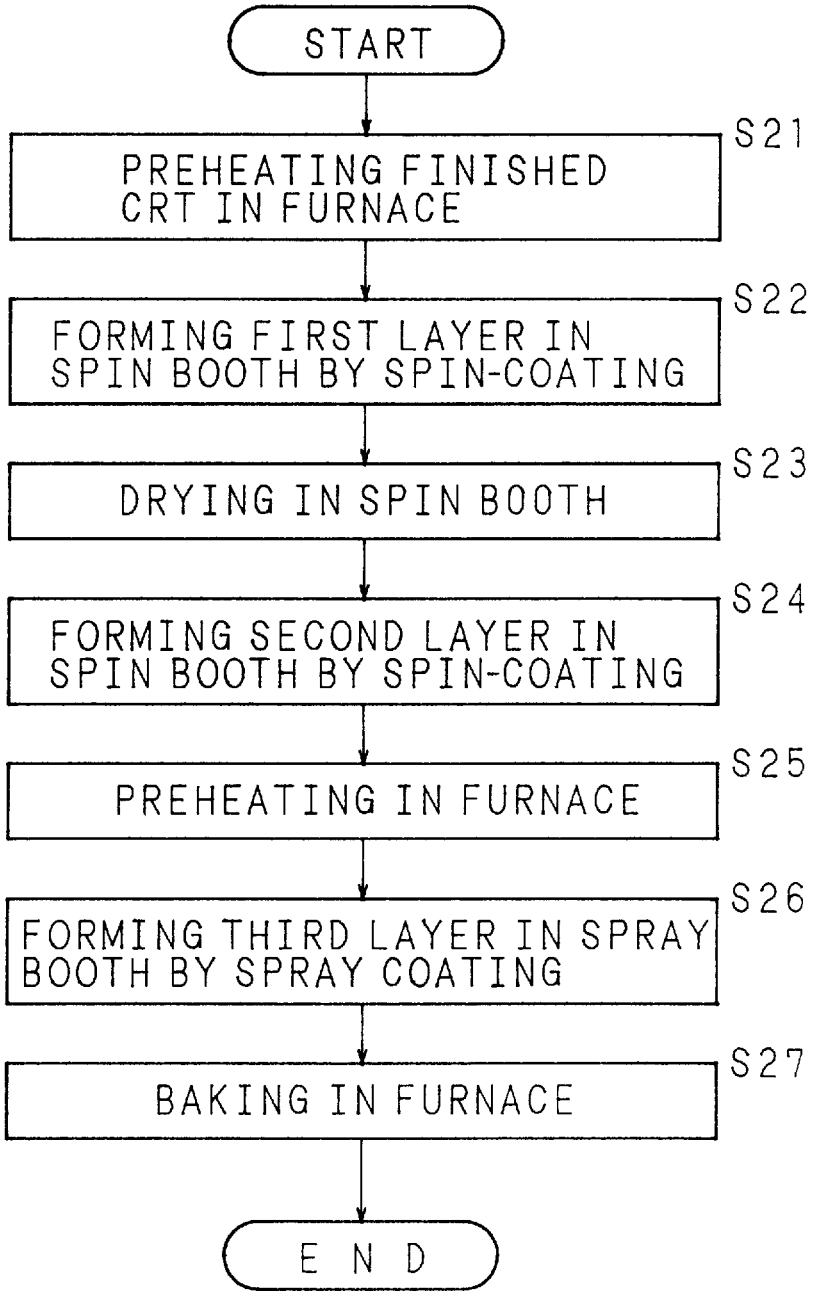
FIG. 5 is a flow chart illustrating a step of production process for forming the triple coat layer of the first embodiment.
Figure 6:
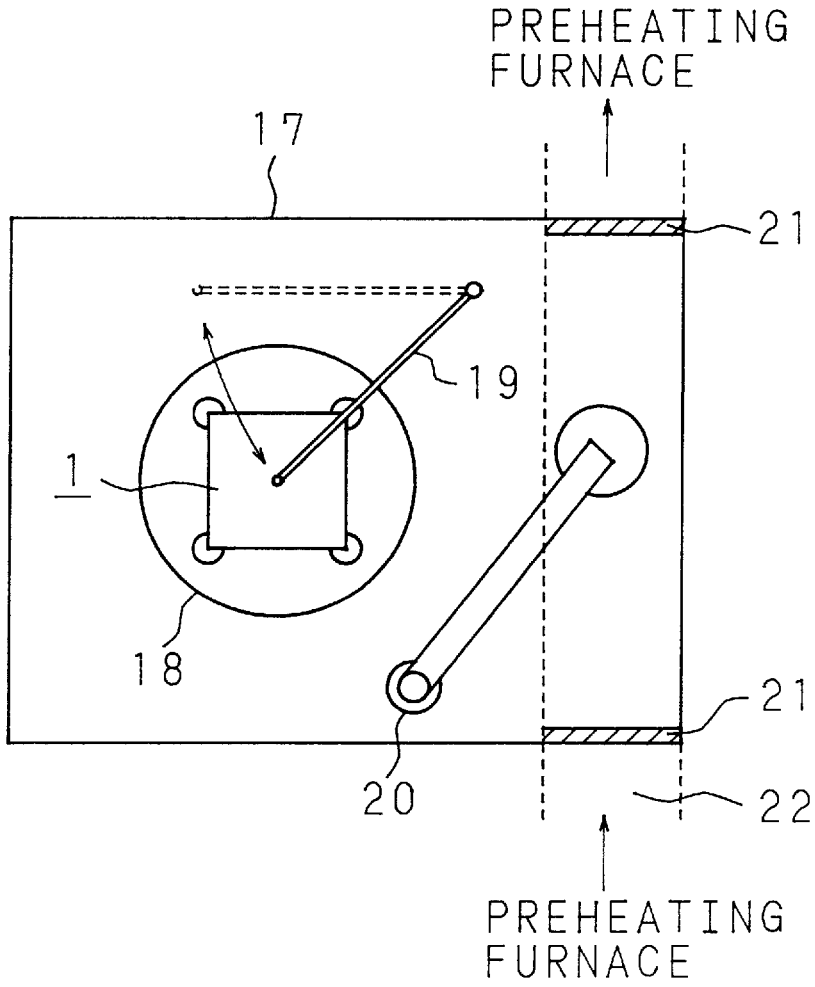
FIG. 6 is a plan view schematically showing a spin booth used in the first embodiment.

Next, a method of forming a triple-layer coat 13 for a CRT of above structure will be described. FIG. 5 is a flow chart showing time process of producing the triple coat layer. As shown in the flow chart, the face plate section of a finished CRT is heated in a preheating furnace so that its temperature reaches 40° to 50° C. (step S21 of FIG. 5). The finished CRT thus preheated is carried into a spin booth. FIG. 6 is a plan view schematically showing the spin booth used in the present embodiment.

As shown in FIG. 6, the spin booth 17 incorporates a conveyor 22 on which the CRT 1 is placed and moved between a pair of shutters 21, which are opposingly provided on the walls of the spin booth 17, so as to be carried out of or into the spin booth 17. In the spin booth 17 are disposed a robot 20 for moving and placing the CRT and a rotatable spin table 18. On the spin table 18 is provided a coating-solution dispenser 19 having a plurality of nozzles.

The CRT 1, which has been carried in, is placed on the spin table 18 by the robot 20 and there subjected to rotation, so that a first high-refractive conductive layer 14 is spin-coated on the face plate of the CRT 1 (step S22 of FIG. 5). After the rotation of the spin table 18 is stopped, the resulting high-refractive smooth conductive layer 14 is dried, followed by the formation of a second low-refractive smooth transparent layer 15 by spin coating (step S24 of FIG. 5). In forming the first and second layers, coating solutions are injected by using their respective independent nozzles. The time schedule for spin coating and the number of revolutions of the spin table 18 are shown in Table 1.

TABLE 1

| | TIME (sec) | REVOLUTIONS |
|---|---|---|
| SPINNING FOR THE FIRST LAYER | 100 | 200 |
| DRYING | 100 | 0 |
| SPINNING FOR THE SECOND LAYER | 100 | 200 |

After the coating for the second layer is completed, the CRT is placed again on the conveyor 22 by the robot 20, so as to be carried out of the spin booth 17 through the shutter 21. Then, the face plate section 3 is heated in the preheating furnace so that its temperature reaches 70° to 80° C. (step S25 of FIG. 5). Thereafter, a third low-refractive rough transparent layer 16 is formed by spray coating in a spray booth (step S26 of FIG. 5), which is then cured by baking at 150° to 200° C. in the furnace (step S27 of FIG. 5), thereby forming a CRT of the triple-layer low-reflective coat.

The solution used here for forming the first layer is SUMICE FINE:ARS-M-1, ARS-M-2, ARS-M-3 or ARS-M-4 available from Sumitomo Cement Co., Ltd. The solution used here for forming the second layer is SUMICE FINE:ARG-M-1 available from Sumitomo Cement Co., Ltd. The solution used here for forming the third layer is Colcoat R available from Colcoat Co., Ltd.

In forming the triple-layer coat 13 according to the method described above, the maximum low-reflective effect can be obtained by setting the optical film thickness of the high-refractive smooth conductive layer 14 to ¼ of the specified wavelength of incident light and by setting the optical film thickness (refractive index×film thickness) of the combined layer of the low-refractive smooth transparent layer 15 and low-refractive rough transparent layer 16, deposited on the surface thereof, to ¼ of the above specified wavelength. Therefore, when the specified wavelength is set to 550 nm, which is highly luminous to the viewer, the face plate section 3 composed of face plate glass, the first light-refractive smooth conductive layer 14, second low-refractive smooth transparent layer 15, and third low-refractive rough transparent layer 16 have refractive indices of $n_G$=1.536, $n_1$=1.6, $n_2$=1.47, and $n_3$=1.47 respectively, so that the first high-refractive smooth conductive layer 14 is formed to have a film thickness of $a_1$=83 nm and the second low-refractive smooth transparent layer 15 and third low-refractive rough transparent layer 16 are formed to have a combined film thickness of $a_{23}$=94 nm (see FIG. 4). In this case, the surface reflectance of 1.0% was obtained with the incident light of 550 nm. While a wavelength of 550 nm was specified in this embodiment, the present invention is not limited thereto.

Figure 7:
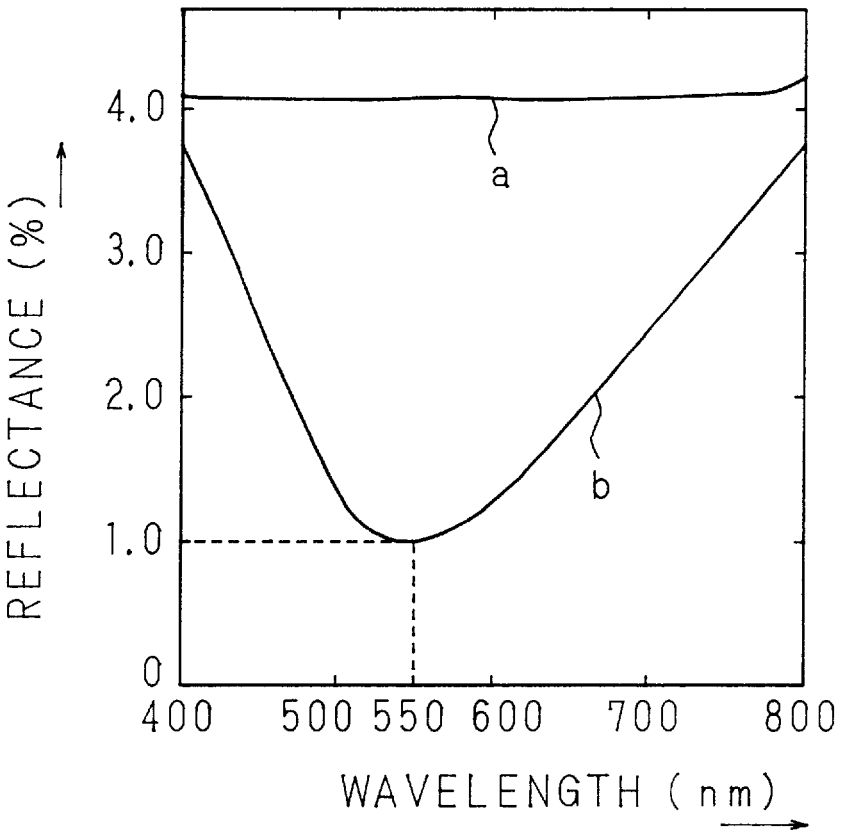
FIG. 7 is a graph showing the surface reflection spectrum in the range of visible light of the first embodiment.

If the third low-refractive rough transparent layer 16 from the side of the face plate section 3 is excessively thick, the glaring effect rather than the low-reflective effect is increased disadvantageously. Hence, the third low-refractive rough transparent layer 16 is formed so that its 60° glossiness with respect to the face plate glass becomes 80%, thus minimizing the deterioration of the resolution and contrast of images displayed. FIG. 7 is a graph showing the surface reflection spectrum in the range of visible light, in which the axis of ordinate represents reflectance and the axis of abscissa represents wavelength. As call be appreciated from the drawing, the characteristic curve b of the CRT with the triple coat layer 13 according to the present embodiment presents the minimum low reflectance of 1.0%, which is about ¼ of the surface reflectance of more than 4% presented by the characteristic curve a of the CRT provided with an unprocessed face plate section 3, so that the reflection of external light can be diminished significantly.

The combination of the low-reflective effect and anti-glaring effect of the outermost layer in the rough configuration sufficiently meets the requirements of the German T ÜV standards on the surface reflection of a display.

Figure 8:
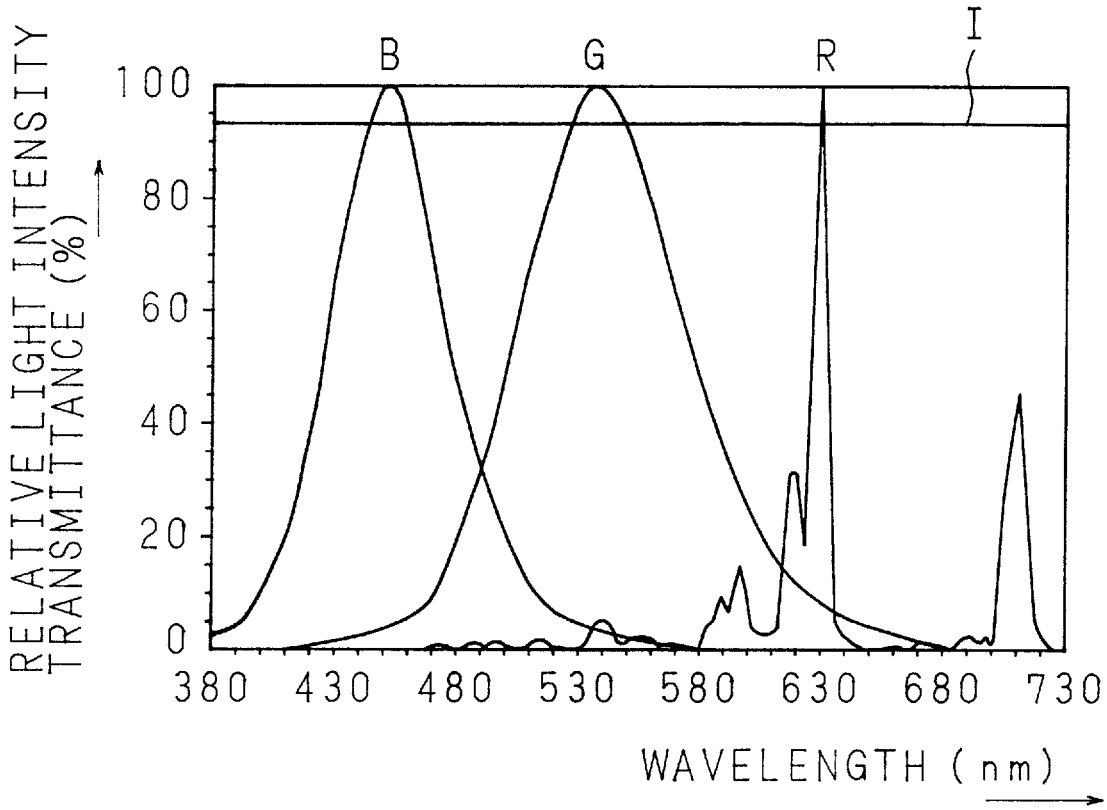
FIG. 8 is a graph showing the light transmittance of the triple coat layer in the range of visible light.

FIG. 8 is a graph showing the light transmittance in the range of visible light, in which the axis of ordinate represents relative light intensity and transmittance and the axis of abscissa represents wavelength. As can be appreciated from the drawing, light transmittance I becomes 95% in the range of visible light due to carbon black having a particle diameter of 200 to 300 A which is contained in the first high-refractive smooth conductive layer 14, so that the deterioration of contrast caused by the rough configuration of the third layer can sufficiently be compensated, while the lowering of luminance is minimized.

Moreover, since carbon black also has high light resistance, no discoloration was observed in a sun-light exposure test (6 hours under fine weather) and in a mercury-lamp) forced exposure test (intensity of ultraviolet ray: 2.2 $mW/cm^2$×42 min.: at 250 nm), each performed on the CRT with the triple coat layer 13 thereon.

Figure 9:
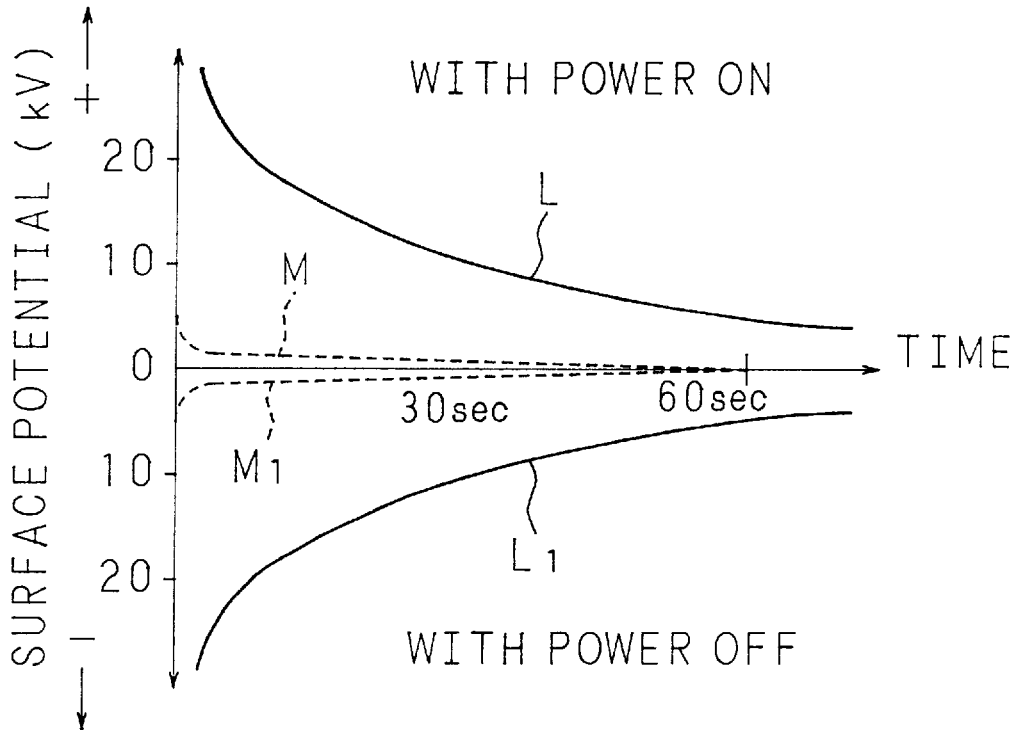
FIG. 9 is a graph showing the surface potential attenuation characteristics of the first embodiment.

FIG. 9 is a graph showing the surface potential attenuation characteristics, in which the axis of ordinate represents surface potential and the axis of abscissa represents time. The characteristic curves M and $M_1$ shown by broken lines in the graph represent the transition of the potential on the outer surface of the face plate section 3 in the on and off states of the power source when the surface resistance value of the triple coat layer 13 is $3\times10^7$ Ω/□. It can be appreciated that the charging up is greatly reduced, compared with the characteristic curves L and $L_1$ of the unprocessed CRT shown by solid lines.

Because the second low-refractive smooth transparent layer 15 and third low-refractive rough transparent layer 16 from the side of the face plate section 3 are pure silica films with no additives, they also serve as overcoats for the first layer by baking them at 150° to 200° C. When abrasion tests were repeated 50 or more times by using a pencil having a hardness of 9H or more on the basis of JIS K 5400 and a plastic eraser (LION 50-30), scars were not observed, thus obtaining the triple coat layer 13 which is excellent in film strength.

Moreover, fingerprints seldom remain on the outer surface of the triple coat layer 13 due to the rough configuration of the third layer. Even when fingerprints are left on the surface, the triple coat layer 13 has sufficient film strength to withstand a cleaning process for removing them.

With the triple coat layer 13 thus constituted, the deterioration of the resolution and contrast of images displayed was minimized, the reflection of external light was diminished, and the CRT of anti-static type having sufficient film strength for practical use was advantageously obtained at lower cost.

(Second Embodiment)

After the first high-refractive conductive layer was formed by spill coating, a drying process is performed while rotating the spin table 18 of FIG. 6, similarly to the production process shown in FIG. 5 of the first embodiment. The time schedule and the number of revolutions used here are shown in Table 2. The materials used here are the same as those of the above first embodiment.

TABLE 2

| | TIME (sec) | REVOLUTIONS |
|---|---|---|
| SPINNING FOR THE FIRST LAYER | 100 | 200 |
| DRYING | 50 | 100 |
| SPINNING FOR THE SECOND LAYER | 100 | 200 |

The reflecting performance and film strength of the triple coat layer obtained here were exactly the same as those obtained in the first embodiment. However, the time required for drying the first layer was advantageously reduced by 30 sec. If dust is allowed to land on the face plate before the first layer is completely dried, spotting defectives are generated. However, by performing the drying process while spinning the face plate, the landing of dust was prevented by an air flow which results from the spinning of the CRT, so that the spotting defectives were significantly reduced.

In the case where spinning is stopped during the drying process, as in the first embodiment, if the temperature of the face plate section is lower than the predetermined temperature in forming the first high-refractive conductive layer by spin coating, the time required for drying the first layer becomes longer than the line index, so that the second layer may be disadvantageously formed by spin coating before the drying process is completed, resulting in the generation of defectives. However, by performing the drying process while spinning the face plate, as in the present embodiment, the air flow resulting from the spinning of the CRT serves to stabilize the drying process, thus completely eliminating the generation of such defectives.

(Third Embodiment)

Below, a third embodiment will specifically be described with reference to the drawings.

Figure 10:
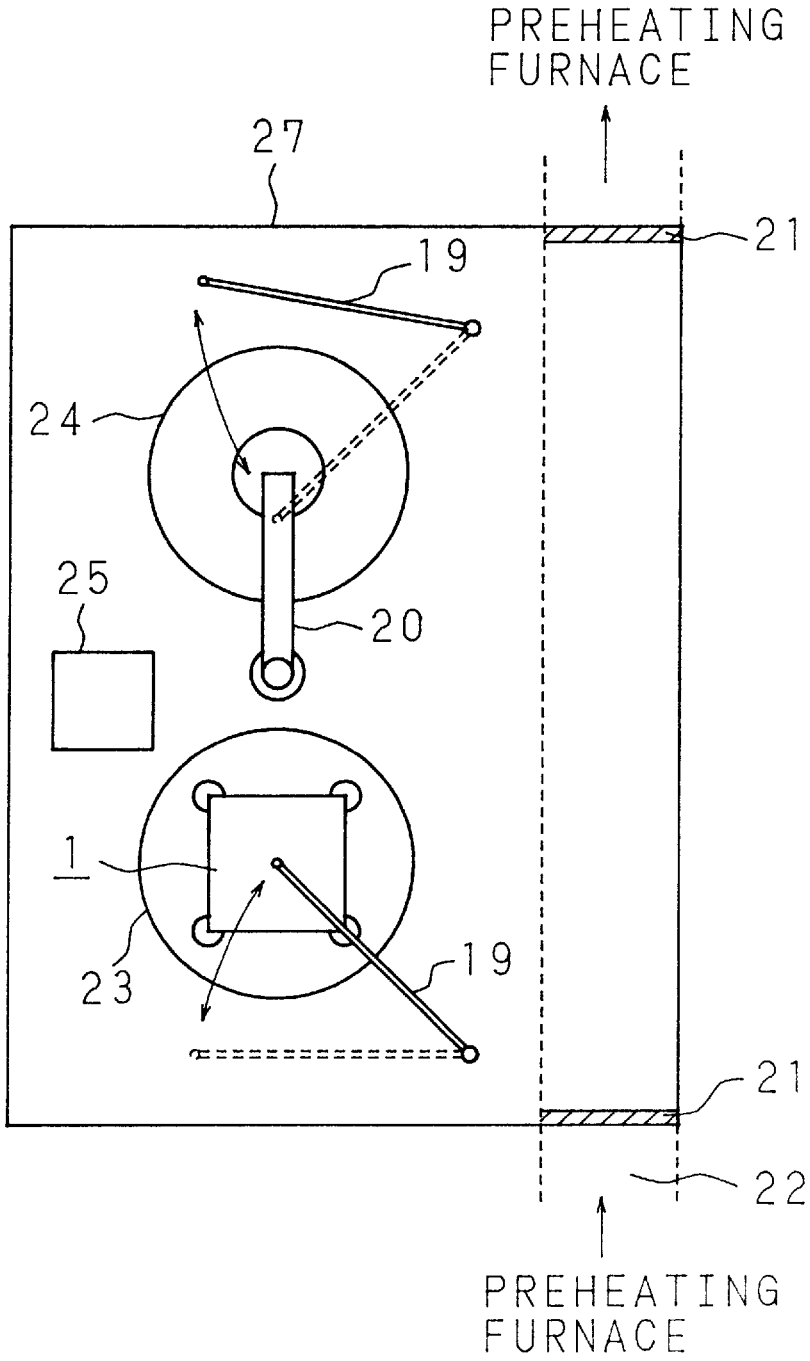
FIG. 10 is a plan view schematically showing a spin booth used in a third embodiment.
Figure 11:
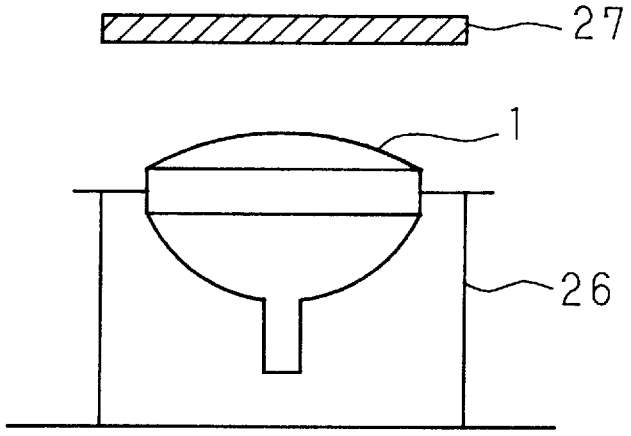
FIG. 11 is a side view schematically showing the structure of a drying position of the third embodiment.

FIG. 10 is a plan view schematically showing a spin booth used in the present embodiment. In the drawing, numeral 27 denotes the spin booth in which the robot 20 for moving and placing the CRT and first and second spin tables 23 and 24 are disposed. On each of the spin tables is provided a coating-solution dispenser 19 having a nozzle. In the spin booth 27 is also disposed a drying position 25. The robot 20 is so constituted as to move the CRT 1 to be placed on the first spin table 23, on the second spin table 24, or in the drying position 25. FIG. 11 is a side view schematically showing the structure of the drying position which consists of a CRT stage 26 and an air blower 27 placed above the CRT stage 26. The surface of the face plate section of the CRT 1 fixed onto the CRT stage 26 is dried by the air blower 27. Although the present embodiment uses the air blower 27, it is also possible to use a drying means, such as a heater, instead.

When a triple-layer coat is formed on the face plate section of the CRT 1 by means of the spin booth thus constituted, the face plate section placed on the first spin table 23 is spin-coated with the first layer and then the CRT 1 is moved by the robot 20 to be placed in the drying position 25. The first layer is dried at the drying position 25, and after that, the CRT 1 is moved again by the robot 20 to be placed on the second spin table 24, so that the second layer is formed on the surface of the first layer by spin coating. The time schedule and the number of revolutions used here are shown in Table 3. The materials of coating solutions are the same as those shown in the first embodiment.

TABLE 3

| | TIME (sec) | REVOLUTIONS |
|---|---|---|
| SPINNING FOR THE FIRST LAYER | 100 | 200 |
| DRYING | 25 | — |
| SPINNING FOR THE SECOND LAYER | 100 | 200 |

After the formation of the second layer, the CRT 1 is carried out of the spin booth 27 and subjected to baking in a furnace. The triple coat layer thus obtained has the same optical properties and film strength as those obtained in the first and second embodiments. Since the spinners are individually provided for the first and second layers, it becomes possible to easily adjust the number of revolutions of the spinner and the time for each layer, even when the properties of the materials of the coating solution such as the evaporation speed and viscosity of the solvent change, so that the stabilization of optical properties can easily be intended. Furthermore, since the time required for drying the first layer can be reduced compared with that of the above first or second embodiment, the further stabilization of optical characteristics can be achieved.

(Fourth Embodiment)

Although the structure of the triple coat layer 13 is the same as that of the first embodiment, the film thickness of the third low-refractive rough transparent layer 16 is reduced compared with that in the first embodiment, so that the 60° glossiness with respect to the face plate glass becomes 85%. The present embodiment can use the production process of the first, second, or third embodiment. Although the surface reflectance, film strength, and anti-static effect obtained here are substantially the same as those obtained in the first embodiment, the degree of deterioration of the resolution and contrast of images displayed due to the rough configuration is reduced compared with that of the first embodiment. However, since the anti-glaring effect due to the rough configuration becomes smaller, the allowance for the German TÜV standards on the surface reflection of a display is decreased.

(Fifth Embodiment)

Although the structure of the triple coat layer 13 is the same as that of the first embodiment, the film thickness of the third low-refractive rough transparent layer 16 is increased compared with that in the first embodiment, so that the 60° glossiness with respect to the face plate glass becomes 75%. The present embodiment can use the production process of the first, second, or third embodiment. Although the surface reflectance, film strength, and anti-static effect obtained here are substantially the same as those obtained in the first embodiment, the degree of deterioration of the resolution and contrast of images displayed due to the rough configuration is increased compared with that of the first embodiment, conversely to the fourth embodiment. Consequently, the anti-glaring effect due to the rough configuration becomes greater, and the allowance for the German TÜV standards on the surface reflection of a display is increased.

As shown in the embodiments 1, 4, and 5, it is possible to combine the anti-glaring effect with the low-reflective effect differently by adjusting the film thickness of the third low-refractive rough transparent layer 16. By controlling the balance between these effects, the degree of deterioration of the resolution and contrast of images displayed can be minimized while satisfying the requirements of the TÜV (T Umlaut V) standards, thus designing the optimum film.

(Sixth Embodiment)

Figure 12:
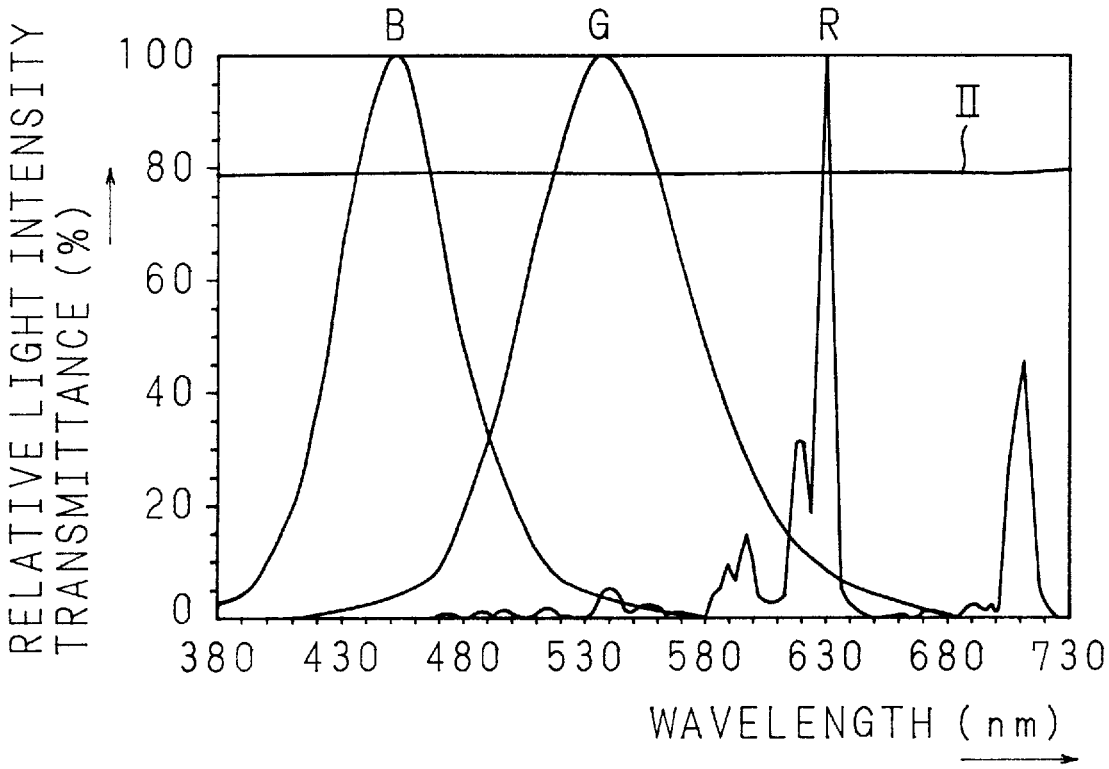
FIG. 12 is a graph showing the light transmittance of the triple coat layer in the range of visible light of a sixth embodiment.

Although the structure of the triple coat layer 13 is the same as that of the first embodiment, the first high-refractive smooth conductive layer 14 is formed by increasing the amount of carbon black contained therein. The present embodiment can use the production process of the first, second, or third embodiment. FIG. 12 is a graph showing the light transmittance in the range of visible light, in which the axis of ordinate represents relative light intensity and transmittance and the axis of abscissa represents wavelength. As can be appreciated from the graph, the characteristic curve 11 of the triple coat layer 13 of the present embodiment presents 80% in the range of visible light.

Figure 13:
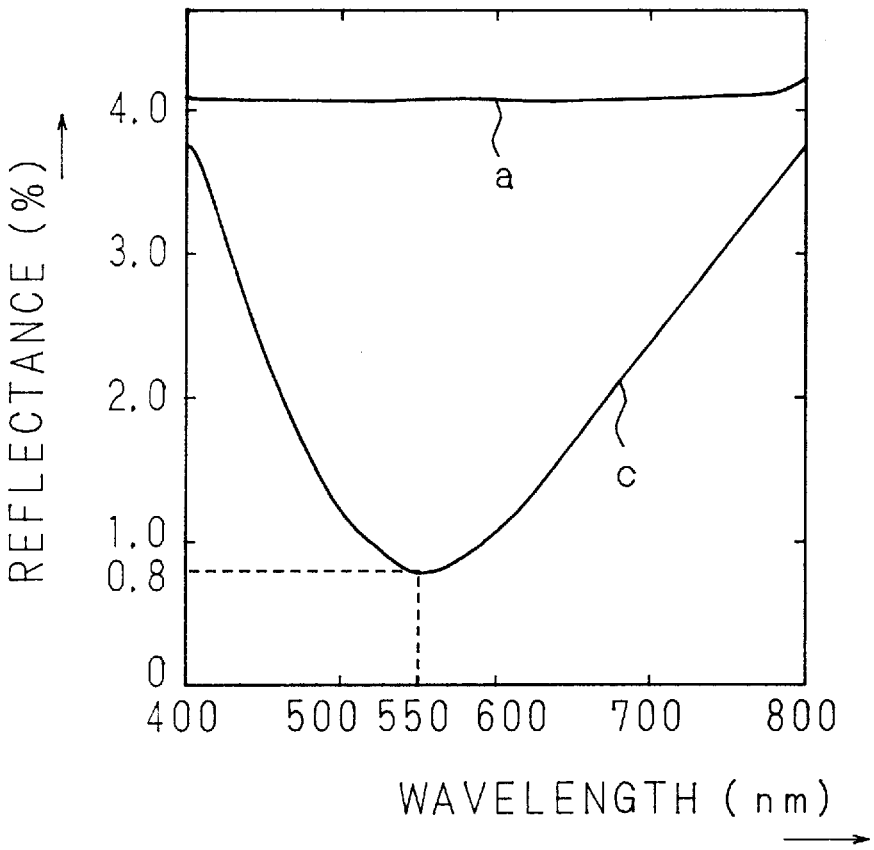
FIG. 13 is a graph showing the surface reflection spectrum in the range of visible light of the sixth embodiment.

FIG. 13 is a graph showing the surface reflection spectrum in the range of visible light in case of FIG. 12, in which the axis of ordinate represents reflectance and the axis of abscissa represents wavelength. In the drawing, the characteristic curve c of the CRT with the triple coat layer 13 of the present embodiment presents a surface reflectance of 0.8% at 550 nm, for the effect of light absorption is added to the low-reflective effect caused by an interference action. By contrast, the characteristic curve a of the CRT with an unprocessed face plate section 3 presents the surface reflectance of more than 4%. Hence, it can be appreciated that the low-reflective effect is increased in the present embodiment.

The present embodiment presents the body color of black which is thicker than that of the first embodiment and the contrast is greatly increased, though its luminance is reduced. However, by adjusting the disperse intensity of carbon black, it becomes possible to establish well-balanced relations among the improvement of contrast, reduction of surface reflectance, and lowering of luminance. The surface resistance value is $1\times10^7$ Ω/□, and the anti-static effect is satisfactory, similarly to the first embodiment.

(Seventh Embodiment)

Although the structure of the triple coat layer 13 is the same as that of the first embodiment, the first high-refractive smooth conductive layer 14 is formed by spin coating with the use of indium oxide ($In_2O_3$), which has lower resistance than tin oxide ($SnO_2$) does. The present embodiment can use the production process of the first, second, or third embodiment. The surface resistance value of the triple coat layer 13 is $2\times10^5$ Ω/□, and the anti-static effect is excellent, similarly to the first embodiment. The results of measurements performed with respect to a leakage electric field (VLF band width) are shown in Table 4.

TABLE 4

| | |
|---|---|
| Measurement Conditions | |
| Measurement Points; | MPR-II: 50 cm anterior to the face plate<br>TCO: 30 cm anterior to the face plate |
| CRT: 17" | |
| HIGH VOLTAGE: 25 kV | |
| HORIZONTAL FREQUENCY: 64 kHz | |
| RASTER SIZE: 100% full scan, back raster | |
| MEASURING DEVICE: EFM200 available from COMBINOVA Co. (measuring device complying with MPR-II recommendation) | |

TABLE 4-continued

| | MPR-II (V/m) | TCO (V/m) |
|---|---|---|
| STANDARD | 2.5 | 1.0 |
| NO COAT | 4.6 | 14.3 |
| 7th EMBODIMENT | 3.7 | 11.4 |

As can be appreciated from Table 4, it is possible in the present embodiment to reduce the leakage electric field (VLF band width) compared with only CRT itself with no coat layer, but it is impossible for the CRT to singly satisfy the requirements of Sweden standards MPR-II and TCO.

However, if used in combination with a display monitor set, the CRT can be screened from the leakage electric field (VLF).

Moreover, only CRT itself can singly satisfy the requirements of the MPR-II and TCO standards by setting the surface resistance value of the triple coat layer 13 to $3\times10^3$ Ω/□ or less.

Figure 14:
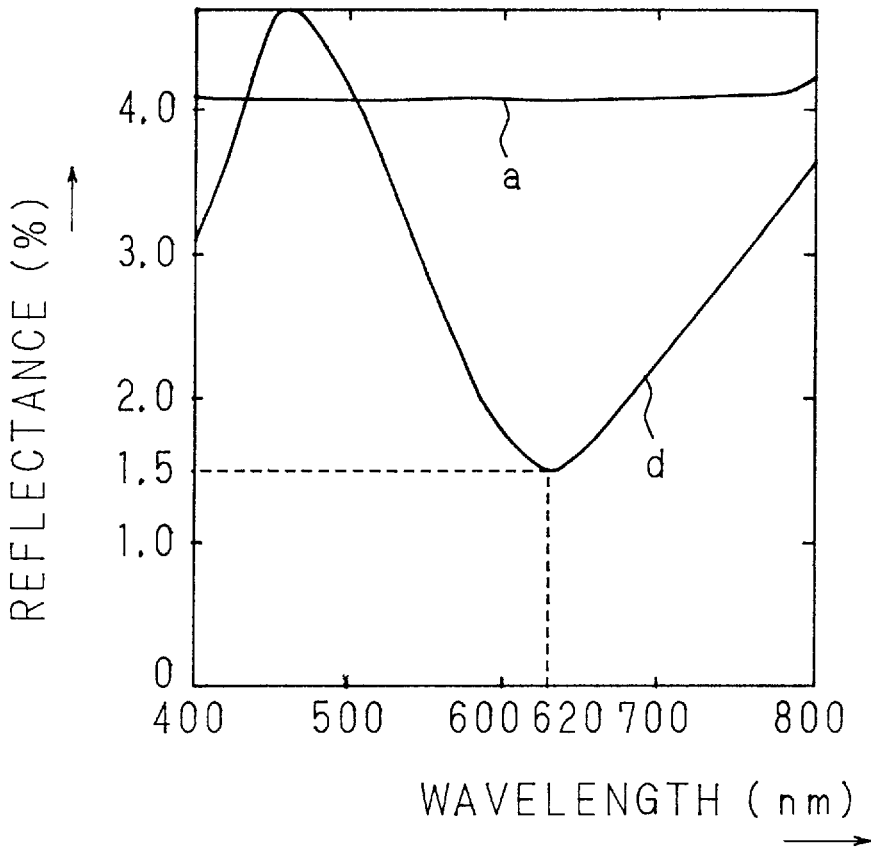
FIG. 14 is a graph showing the surface reflection spectrum in the range of visible light of a seventh embodiment.

FIG. 14 is a graph showing the surface reflection spectrum in the range of visible light, in which the axis of ordinate represents reflectance and the axis of abscissa represents wavelength. As can be appreciated from the drawing, the characteristic curved of the CRT with the triple coat layer 13 of the present embodiment presents the minimum low reflectance of 1.5% at 620 nm, while the characteristic curve a of the CRT with an unprocessed face plate section 3 presents the surface reflectance of 4%, so that the sufficient low-reflective effect was obtained.

In the embodiments described above, the application of the first high-refractive conductive layer and second low-refractive smooth transparent layer is immediately followed by preheating and by the application of the third low-refractive rough transparent layer. However, it is also possible to bake the first high-refractive conductive layer and second low-refractive smooth transparent layer immediately after they were applied, so as to provide a CRT with a double-layer low-reflective smooth coat. The method will be described below.

(Eighth Embodiment)

Figure 15:
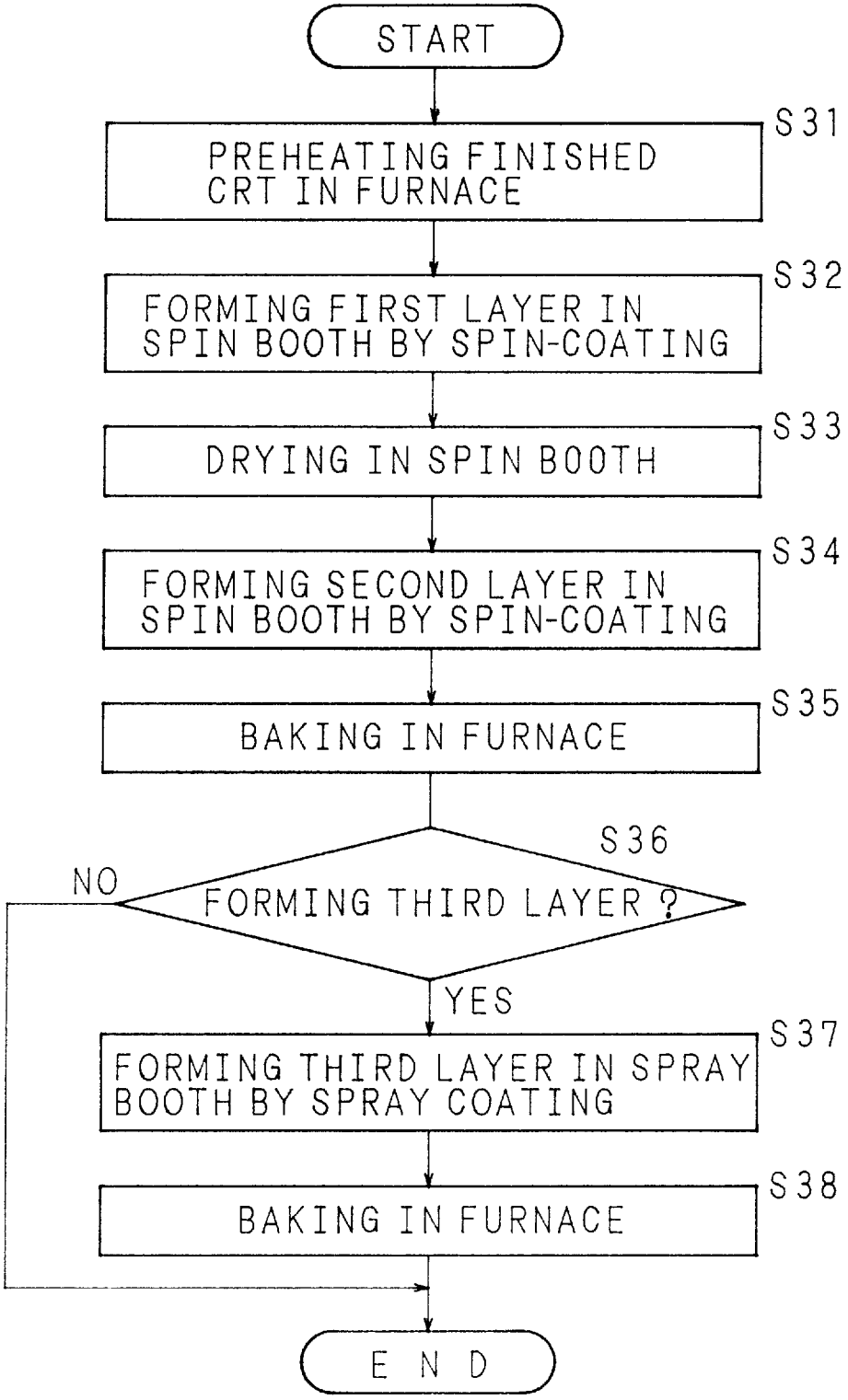
FIG. 15 is a flow chart showing a step of production process for forming the triple coat layer of an eighth embodiment.

FIG. 15 is a flow chart showing the production process of an eighth embodiment. As shown in the drawing, a finished CRT is preheated in the preheating furnace so that the temperature of its face plate section reaches 40° to 50° C. (step S31 of FIG. 15). Then, the CRT is carried into the spin booth as shown in FIG. 10, so that the surface of the face plate section of the CRT is spin-coated with the first high-refractive conductive layer (step S32 of FIG. 15). After the resulting high-refractive smooth conductive layer is dried, the second low-refractive smooth transparent layer is formed by spin coating in the same spin booth (step S34 of FIG. 15).

After the application of the second layer is completed, the CRT is carried out of the spin booth and subjected to baking at 150° to 200° C., thus forming the CRT with the double-layer low-reflective coat. After abrasion tests were repeated 30 times by using a pencil having a 7H hardness on the basis of JIS K 5400 and a plastic eraser (LION 50-30), it was concluded that the film strength of the double coat layer thus obtained is slightly lower than that of the triple coat layer, but the double coat layer would present no problem in practical use. The optical properties of the double coat layer are substantially the same as those obtained in the first, second, and third embodiments.

In case of forming the third low-refractive rough transparent layer on the double coat layer (step S36 of FIG. 15), the CRT with the double-layer low-reflective coat is heated in the preheating furnace so that the temperature of its face plate section reaches 70° to 80° C. Alternatively, the temperature is allowed to drop to 40° to 50° C. after baking. The third low-refractive rough transparent layer is formed by spray coating in the spray booth (step S37 of FIG. 15), and then cured by baking at 150° to 200° C. (step S38 of FIG. 15), thus forming a CRT with the triple-layer low-reflective coat. The optical properties and film strength of the triple coat layer thus obtained are exactly the same as those obtained in the first, second, and third embodiments.

Although the eighth embodiment used the spin booth provided with the first and second spinners and drying means, as shown in FIG. 10, in order to form the high-refractive conductive layer and low-refractive transparent layer, it is also possible to use the spin booth as shown in FIG. 6, so that they are formed by the same spinner.

As described above, the CRT according to the present invention is provided with the triple coat layer consisting of the high-refractive conductive layer, low-refractive smooth transparent layer, and low-refractive rough transparent layer on the outer surface of its face plate section. Therefore, it can exert the effect of diminishing the reflection of external light without sharpening the contours of reflected images.

Moreover, the optical film thickness of the high-refractive conductive layer is set to ¼ of the wavelength of visible light, the optical film thickness of the combined layer of the low-refractive smooth transparent layer and low-refractive rough transparent layer is set to ¼ of the wavelength of visible light, and the 60° glossiness of the low-refractive rough transparent layer with respect to the face plate glass is adjusted to 75 to 85%. Consequently, the effect of optimizing the balance between the glaring effect and low-reflective effect can be exerted.

Since the high-refractive conductive layer and low-refractive smooth transparent layer are formed by spin coating and the low-refractive rough transparent layer is formed by spray coating, the effect of producing the CRT provided with the triple coat layer having excellent film quality at lower cost can be exerted.

Since the high-refractive conductive layer, low-refractive smooth transparent layer, and low-refractive rough transparent layer which have been sequentially applied are cured by baking at about 150° to 200° C., the effect of producing the CRT provided with the triple coat layer which has sufficient film strength for practical use can be exerted.

Since the high-refractive conductive layer and low-refractive smooth transparent layer, which have been sequentially applied, are cured by baking at 150° to 200° C., for example, the effect of producing the double coat layer which has sufficient film strength for practical use can be exerted.

Since the high-refractive conductive layer and low-refractive smooth transparent layer are formed by the same spinner in the same apparatus, the effect of producing the CRT provided with the double or triple coat layer having excellent film performance and quality at lower cost can be exerted.

Since the process of drying the high-refractive conductive layer is performed by spinning the CRT, the spotting defectives can be reduced, so that the effect of producing the CRT provided with the double or triple coat layer having excellent film performance and quality at further lower cost can be exerted.

Since the drying means such as an air blower or heater is provided in the apparatus so that the high-refractive conductive layer, which has been formed, is dried by the foregoing drying means and then the low-refractive transparent layer is formed in the same apparatus, the process of drying the first layer can be performed stably. Hence, the effect of producing the CRT provided with the double or triple coat layer having excellent film performance and quality at further lower cost can be exerted.

As this invention may be embodied in several forms without departing from the spirit of essential characteristic thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A method of producing a cathode-ray tube provided with a face plate on whose outer surface a coat layer is formed, comprising the steps of:

forming a high-refractive transparent conductive layer on the surface of said face plate by spin coating;

forming a low-refractive smooth transparent layer on the surface of said high-refractive transparent conductive layer by spin coating; and forming a low-refractive rough transparent layer on the surface of said low-refractive smooth transparent layer by spray coating;

wherein said high-refractive transparent conductive layer has a high-refractive index relative to said low-refractive smooth transparent layer and said low-refractive rough transparent layer, and said low-refractive smooth transparent layer and said low-refractive rough transparent layer have low-refractive indices relative to said high-refractive transparent conductive layer.

2. A method of producing a cathode-ray tube according to claim 1, further comprising the step of:

curing said high-refractive transparent conductive layer, low-refractive smooth transparent layer, and low-refractive rough transparent layer by baking after they are formed.

3. A method of producing a cathode-ray tube according to claim 2, wherein said high-refractive transparent conductive layer, low-refractive smooth transparent layer, and low-refractive rough transparent layer are cured by baking at 150° to 200° C.

4. A method of producing a cathode-ray tube according to claim 2, wherein said high-refractive transparent conductive layer and low-refractive smooth transparent layer are formed by using the same spinner in the same apparatus.

5. A method of producing a cathode-ray tube according to claim 2, further comprising:

drying said high-refractive transparent conductive layer after said high-refractive transparent conductive layer is formed and while said high-refractive transparent conductive layer is being spun.

6. A method of producing a cathode-ray tube according to claim 2, wherein said step of forming said high-refractive transparent conductive layer includes the step of spin coating said high-refractive transparent conductive layer using a first spinner and drying said high-refractive transparent conductive layer using a drying means so as to form and dry said high-refractive transparent conductive layer; and said step of forming said low-refractive smooth transparent layer includes the step of spin coating said low-refractive smooth transparent layer using a second spinner.

7. A method of producing a cathode-ray tube provided with a face plate on whose outer surface a coat layer is formed, comprising the steps of;

forming a high-refractive transparent conductive layer on the outer surface of the face plate by spin coating;

forming a low-refractive smooth transparent layer on the surface of said high-refractive conductive layer by spin coating, said low-refractive smooth transparent layer having a low-refractive index relative to said high-refractive transparent conductive layer and said high-refractive transparent conductive layer having a high-refractive index relative to said low-refractive smooth transparent layer; and curing said high-refractive transparent conductive layer and said low-refractive smooth transparent layer by baking after forming said high-refractive transparent conductive layer and said low-refractive smooth transparent layer.

8. A method of producing a cathode-ray tube according to claim 7, wherein said high-refractive transparent conductive layer and low-refractive smooth transparent layer are cured by baking at 150° to 200° C.

9. A method of producing a cathode-ray tube according to claim 7, wherein said high-refractive transparent conductive layer and low-refractive smooth transparent layer are formed by using the same spinner in the same apparatus.

10. A method of producing a cathode-ray tube according to claim 7, further comprising:

drying said high-refractive transparent conductive layer after said high-refractive transparent conductive layer is formed and while said high-refractive transparent conductive layer is being spun.

11. A method of producing a cathode-ray tube according to claim 7, wherein:

said step of forming said high-refractive transparent conductive layer includes the step of spin coating said high-refractive transparent conductive layer using a first spinner and drying said high-refractive transparent conductive layer using a drying means so as to form and dry said high-refractive transparent conductive layer; and said step of forming said low-refractive smooth transparent layer includes the step of spin coating said low-refractive smooth transparent layer using a second spinner.

* * * * *